US009167950B2

(12) United States Patent
Tuller et al.

(10) Patent No.: US 9,167,950 B2
(45) Date of Patent: Oct. 27, 2015

(54) DISHWASHER WITH FILTER ASSEMBLY

(71) Applicant: Whirlpool Corporation, Benton Harbor, MI (US)

(72) Inventors: Barry E. Tuller, Stevensville, MI (US); Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/265,684

(22) Filed: Apr. 30, 2014

(65) Prior Publication Data

US 2014/0230852 A1 Aug. 21, 2014

Related U.S. Application Data

(60) Division of application No. 13/164,542, filed on Jun. 20, 2011, now Pat. No. 8,733,376, which is a continuation-in-part of application No. 13/108,026, filed on May 16, 2011.

(51) Int. Cl.
*A47L 15/42* (2006.01)

(52) U.S. Cl.
CPC ..... *A47L 15/4206* (2013.01); *A47L 15/4208* (2013.01); *A47L 15/4225* (2013.01)

(58) Field of Classification Search
CPC ..... A47L 15/4206; A47L 15/4208; A47L 15/4225
USPC ..... 134/10, 56 D, 57 D, 58 D, 104.2, 109, 134/110, 111
See application file for complete search history.

(56) References Cited

U.S. PATENT DOCUMENTS

| | | | |
|---|---|---|---|
| 786,977 | A | 4/1905 | Lehman |
| 1,617,021 | A | 2/1927 | Mitchell |
| 2,154,559 | A | 4/1939 | Bilde |
| 2,422,022 | A | 6/1947 | Koertge |
| 2,734,122 | A | 2/1956 | Flannery |
| 3,016,147 | A | 1/1962 | Cobb et al. |
| 3,026,628 | A | 3/1962 | Berger, Sr. et al. |
| 3,068,877 | A | 12/1962 | Jacobs |
| 3,103,227 | A | 9/1963 | Long |
| 3,122,148 | A | 2/1964 | Alabaster |
| 3,186,417 | A | 6/1965 | Fay |
| 3,288,154 | A | 11/1966 | Jacobs |
| 3,542,594 | A | 11/1970 | Smith et al. |
| 3,575,185 | A | 4/1971 | Barbulesco |
| 3,586,011 | A | 6/1971 | Mazza |
| 3,739,145 | A | 6/1973 | Woehler |

(Continued)

FOREIGN PATENT DOCUMENTS

| | | |
|---|---|---|
| CH | 169630 | 6/1934 |
| CN | 2571812 | 9/2003 |

(Continued)

OTHER PUBLICATIONS

German Search Report for DE102013103625, Jul. 19, 2013.

(Continued)

*Primary Examiner* — Alexander Markoff

(57) ABSTRACT

A dishwasher with a tub at least partially defining a treating chamber, a liquid spraying system, a liquid recirculation system defining a recirculation flow path, and a liquid filtering system. The liquid filtering system includes a filter disposed in the recirculation flow path to filter the liquid.

5 Claims, 12 Drawing Sheets

(56) References Cited

U.S. PATENT DOCUMENTS

| | | | |
|---|---|---|---|
| 3,801,280 | A | 4/1974 | Shah et al. |
| 3,846,321 | A | 11/1974 | Strange |
| 3,906,967 | A | 9/1975 | Bergeson |
| 3,989,054 | A | 11/1976 | Mercer |
| 4,179,307 | A | 12/1979 | Cau et al. |
| 4,180,095 | A | 12/1979 | Woolley et al. |
| 4,326,552 | A | 4/1982 | Bleckmann |
| 4,754,770 | A | 7/1988 | Fornasari |
| 5,002,890 | A | 3/1991 | Morrison |
| 5,030,357 | A | 7/1991 | Lowe |
| 5,133,863 | A | 7/1992 | Zander |
| 5,331,986 | A | 7/1994 | Lim et al. |
| 5,454,298 | A | 10/1995 | Lu |
| 5,470,142 | A | 11/1995 | Sargeant et al. |
| 5,470,472 | A | 11/1995 | Baird et al. |
| 5,557,704 | A | 9/1996 | Dennis et al. |
| 5,569,383 | A | 10/1996 | Vander Ark, Jr. et al. |
| 5,618,424 | A | 4/1997 | Nagaoka |
| 5,711,325 | A | 1/1998 | Kloss et al. |
| 5,755,244 | A | 5/1998 | Sargeant et al. |
| 5,782,112 | A | 7/1998 | White et al. |
| 5,803,100 | A | 9/1998 | Thies |
| 5,865,997 | A | 2/1999 | Isaacs |
| 5,868,937 | A | 2/1999 | Back et al. |
| 5,904,163 | A | 5/1999 | Inoue et al. |
| 5,924,432 | A | 7/1999 | Thies et al. |
| 6,289,908 | B1 | 9/2001 | Kelsey |
| 6,389,908 | B1 | 5/2002 | Chevalier et al. |
| 6,460,555 | B1 | 10/2002 | Tuller et al. |
| 6,491,049 | B1 | 12/2002 | Tuller et al. |
| 6,601,593 | B2 | 8/2003 | Deiss et al. |
| 6,666,976 | B2 | 12/2003 | Benenson, Jr. et al. |
| 6,800,179 | B2 | 10/2004 | Wang |
| 6,997,195 | B2 | 2/2006 | Durazzani et al. |
| 7,047,986 | B2 | 5/2006 | Ertle et al. |
| 7,069,181 | B2 | 6/2006 | Jerg et al. |
| 7,093,604 | B2 | 8/2006 | Jung et al. |
| 7,153,817 | B2 | 12/2006 | Binder |
| 7,198,054 | B2 | 4/2007 | Welch |
| 7,208,080 | B2 | 4/2007 | Batten et al. |
| 7,232,494 | B2 | 6/2007 | Rappette |
| 7,250,174 | B2 | 7/2007 | Lee et al. |
| 7,270,132 | B2 | 9/2007 | Inui et al. |
| 7,319,841 | B2 | 1/2008 | Bateman, III et al. |
| 7,326,338 | B2 | 2/2008 | Batten et al. |
| 7,347,212 | B2 | 3/2008 | Rosenbauer |
| 7,350,527 | B2 | 4/2008 | Gurubatham et al. |
| 7,363,093 | B2 | 4/2008 | King et al. |
| 7,406,843 | B2 | 8/2008 | Thies et al. |
| 7,445,013 | B2 | 11/2008 | VanderRoest et al. |
| 7,497,222 | B2 | 3/2009 | Edwards et al. |
| 7,523,758 | B2 | 4/2009 | Vanderroest et al. |
| 7,594,513 | B2 | 9/2009 | VanderRoest et al. |
| 7,819,983 | B2 | 10/2010 | Kim et al. |
| 8,043,437 | B1 | 10/2011 | Delgado et al. |
| 8,161,986 | B2 | 4/2012 | Alessandrelli |
| 8,215,322 | B2 | 7/2012 | Fountain et al. |
| 8,627,832 | B2 | 1/2014 | Fountain et al. |
| 8,667,974 | B2 | 3/2014 | Fountain et al. |
| 8,746,261 | B2 | 6/2014 | Welch |
| 2002/0017483 | A1 | 2/2002 | Chesner et al. |
| 2003/0037809 | A1 | 2/2003 | Favaro |
| 2003/0205248 | A1 | 11/2003 | Christman et al. |
| 2004/0007253 | A1 | 1/2004 | Jung et al. |
| 2004/0103926 | A1 | 6/2004 | Ha |
| 2005/0022849 | A1 | 2/2005 | Park et al. |
| 2005/0133070 | A1 | 6/2005 | Vanderroest et al. |
| 2006/0005863 | A1 | 1/2006 | Gurubatham et al. |
| 2006/0054549 | A1 | 3/2006 | Schoendorfer |
| 2006/0123563 | A1 | 6/2006 | Raney et al. |
| 2006/0162744 | A1 | 7/2006 | Walkden |
| 2006/0174915 | A1 | 8/2006 | Hedstrom et al. |
| 2006/0236556 | A1 | 10/2006 | Ferguson et al. |
| 2006/0237049 | A1 | 10/2006 | Weaver et al. |
| 2007/0006898 | A1 | 1/2007 | Lee |
| 2007/0107753 | A1 | 5/2007 | Jerg |
| 2007/0163626 | A1 | 7/2007 | Klein |
| 2007/0186964 | A1 | 8/2007 | Mason et al. |
| 2007/0246078 | A1 | 10/2007 | Purtilo et al. |
| 2007/0266587 | A1 | 11/2007 | Bringewatt et al. |
| 2008/0116135 | A1 | 5/2008 | Rieger et al. |
| 2008/0289654 | A1 | 11/2008 | Kim et al. |
| 2008/0289664 | A1 | 11/2008 | Rockwell et al. |
| 2009/0095330 | A1 | 4/2009 | Iwanaga et al. |
| 2009/0283111 | A1 | 11/2009 | Classen et al. |
| 2010/0012159 | A1 | 1/2010 | Verma et al. |
| 2010/0043826 | A1 | 2/2010 | Bertsch et al. |
| 2010/0043828 | A1 | 2/2010 | Choi et al. |
| 2010/0043847 | A1 | 2/2010 | Yoon et al. |
| 2010/0121497 | A1 | 5/2010 | Heisele et al. |
| 2010/0154830 | A1 | 6/2010 | Lau et al. |
| 2010/0154841 | A1* | 6/2010 | Fountain et al. ..... 134/104.2 |
| 2010/0224223 | A1 | 9/2010 | Kehl et al. |
| 2010/0252081 | A1 | 10/2010 | Classen et al. |
| 2010/0300499 | A1 | 12/2010 | Han et al. |
| 2011/0061682 | A1 | 3/2011 | Fountain et al. |
| 2011/0120508 | A1* | 5/2011 | Yoon et al. ..... 134/104.1 |
| 2011/0126865 | A1* | 6/2011 | Yoon et al. ..... 134/104.1 |
| 2012/0097200 | A1 | 4/2012 | Fountain |
| 2012/0138107 | A1 | 6/2012 | Fountain et al. |
| 2012/0167928 | A1 | 7/2012 | Fountain et al. |

FOREIGN PATENT DOCUMENTS

| | | | |
|---|---|---|---|
| CN | 2761660 | | 3/2006 |
| CN | 1966129 | | 5/2007 |
| CN | 2907830 | | 6/2007 |
| CN | 101406379 | | 4/2009 |
| CN | 201276653 | | 7/2009 |
| CN | 201361486 | | 12/2009 |
| CN | 101654855 | | 2/2010 |
| CN | 201410325 | | 2/2010 |
| CN | 201473770 | | 5/2010 |
| DE | 1134489 | | 8/1961 |
| DE | 1428358 | A1 | 11/1968 |
| DE | 1453070 | | 3/1969 |
| DE | 7105474 | | 8/1971 |
| DE | 7237309 | U | 9/1973 |
| DE | 2825242 | A1 | 1/1979 |
| DE | 3337369 | A1 | 4/1985 |
| DE | 3723721 | A1 | 5/1988 |
| DE | 3842997 | A1 | 7/1990 |
| DE | 4011834 | A1 | 10/1991 |
| DE | 4016915 | A1 | 11/1991 |
| DE | 4131914 | A1 | 4/1993 |
| DE | 9415486 | U1 | 11/1994 |
| DE | 9416710 | U1 | 1/1995 |
| DE | 4413432 | C1 | 8/1995 |
| DE | 4418523 | A1 | 11/1995 |
| DE | 4433842 | | 3/1996 |
| DE | 69111365 | T2 | 3/1996 |
| DE | 19546965 | A1 | 6/1997 |
| DE | 69403957 | T2 | 1/1998 |
| DE | 19652235 | | 6/1998 |
| DE | 10000772 | A1 | 7/2000 |
| DE | 69605965 | T2 | 8/2000 |
| DE | 19951838 | A1 | 5/2001 |
| DE | 10065571 | A1 | 7/2002 |
| DE | 10106514 | A1 | 8/2002 |
| DE | 60206490 | T2 | 5/2006 |
| DE | 60302143 | | 8/2006 |
| DE | 102005023428 | A1 | 11/2006 |
| DE | 102005038433 | A1 | 2/2007 |
| DE | 102007007133 | A1 | 8/2008 |
| DE | 102007060195 | A1 | 6/2009 |
| DE | 202010006739 | U1 | 8/2010 |
| DE | 102009027910 | A1 | 1/2011 |
| DE | 102009028278 | A1 | 2/2011 |
| DE | 102011052846 | A1 | 5/2012 |
| DE | 102012103435 | A1 | 12/2012 |
| EP | 0068974 | A1 | 1/1983 |
| EP | 0178202 | A1 | 4/1986 |
| EP | 0198496 | A1 | 10/1986 |
| EP | 0208900 | A2 | 1/1987 |

(56) References Cited

FOREIGN PATENT DOCUMENTS

| | | | | |
|---|---|---|---|---|
| EP | 0370552 | A1 | | 5/1990 |
| EP | 0374616 | A1 | | 6/1990 |
| EP | 0383028 | A2 | | 8/1990 |
| EP | 0405627 | A1 | | 1/1991 |
| EP | 437189 | A1 | | 7/1991 |
| EP | 0454640 | A1 | | 10/1991 |
| EP | 0521815 | A1 | | 1/1993 |
| EP | 0585905 | A2 | | 9/1993 |
| EP | 0702928 | A1 | | 8/1995 |
| EP | 0597907 | B1 | | 12/1995 |
| EP | 0725182 | A1 | | 8/1996 |
| EP | 0748607 | A2 | | 12/1996 |
| EP | 752231 | A1 | | 1/1997 |
| EP | 0752231 | A1 | | 1/1997 |
| EP | 0854311 | A2 | | 7/1998 |
| EP | 0855165 | A2 | | 7/1998 |
| EP | 0898928 | A1 | | 3/1999 |
| EP | 1029965 | A1 | | 8/2000 |
| EP | 1224902 | A2 | | 7/2002 |
| EP | 1256308 | A2 | | 11/2002 |
| EP | 1264570 | | | 12/2002 |
| EP | 1319360 | A1 | | 6/2003 |
| EP | 1342827 | | | 9/2003 |
| EP | 1346680 | A2 | | 9/2003 |
| EP | 1386575 | A1 | * | 2/2004 |
| EP | 1415587 | | | 5/2004 |
| EP | 1498065 | A1 | | 1/2005 |
| EP | 1583455 | A1 | | 10/2005 |
| EP | 1703834 | A1 | | 9/2006 |
| EP | 1743871 | A1 | | 1/2007 |
| EP | 1862104 | A1 | | 12/2007 |
| EP | 1882436 | A1 | | 1/2008 |
| EP | 1980193 | A1 | | 10/2008 |
| EP | 2127587 | A1 | | 2/2009 |
| EP | 2075366 | A1 | | 7/2009 |
| EP | 2138087 | A1 | | 12/2009 |
| EP | 2332457 | A1 | | 6/2011 |
| FR | 1370521 | A | | 8/1964 |
| FR | 2372363 | A1 | | 6/1978 |
| FR | 2491320 | A1 | | 4/1982 |
| FR | 2491321 | A1 | | 4/1982 |
| FR | 2790013 | A1 | | 8/2000 |
| GB | 973859 | A | | 10/1964 |
| GB | 1047948 | | | 11/1966 |
| GB | 1123789 | A | | 8/1968 |
| GB | 1515095 | | | 6/1978 |
| GB | 2274772 | A | | 8/1994 |
| JP | 55039215 | A | | 3/1980 |
| JP | 60069375 | A | | 4/1985 |
| JP | 61085991 | A | | 5/1986 |
| JP | 61200824 | A | | 9/1986 |
| JP | 1005521 | A | | 1/1989 |
| JP | 1080331 | A | | 3/1989 |
| JP | 5245094 | A | | 9/1993 |
| JP | 07178030 | | | 7/1995 |
| JP | 10109007 | A | | 4/1998 |
| JP | 2000107114 | A | | 4/2000 |
| JP | 2001190479 | A | | 7/2001 |
| JP | 2001190480 | A | | 7/2001 |
| JP | 2003336909 | A | | 12/2003 |
| JP | 2003339607 | A | | 12/2003 |
| JP | 2004267507 | A | | 9/2004 |
| JP | 2005124979 | A | | 5/2005 |
| JP | 2006075635 | A | | 3/2006 |
| JP | 2007068601 | A | | 3/2007 |
| JP | 2008093196 | A | | 4/2008 |
| JP | 2008253543 | A | | 10/2008 |
| JP | 2008264018 | A | | 11/2008 |
| JP | 2008264724 | A | | 11/2008 |
| JP | 2010035745 | A | | 2/2010 |
| JP | 2010187796 | A | | 9/2010 |
| KR | 20010077128 | | | 8/2001 |
| KR | 20090006659 | | | 1/2009 |
| WO | 2005058124 | A1 | | 6/2005 |
| WO | 2005115216 | A1 | | 12/2005 |
| WO | 2007024491 | A2 | | 3/2007 |
| WO | 2007074024 | A1 | | 7/2007 |
| WO | 2008067898 | A1 | | 6/2008 |
| WO | 2008125482 | | | 10/2008 |
| WO | 2009018903 | A1 | | 2/2009 |
| WO | 2009065696 | A1 | | 5/2009 |
| WO | 2009077266 | A1 | | 6/2009 |
| WO | 2009077279 | A2 | | 6/2009 |
| WO | 2009077280 | A1 | | 6/2009 |
| WO | 2009077283 | A1 | | 6/2009 |
| WO | 2009077286 | A1 | | 6/2009 |
| WO | 2009077290 | A1 | | 6/2009 |
| WO | 2009118308 | A1 | | 10/2009 |

OTHER PUBLICATIONS

German Search Report for Counterpart DE102013109125, Dec. 9, 2013.
German Search Report for DE102010061342, Aug. 19, 2011.
European Search Report for EP101952380, May 19, 2011.
European Search Report for EP11188106, Mar. 29, 2012.
European Search Report for EP12188007, Aug. 6, 2013.
German Search Report for DE102010061347, Jan. 23, 2013.
German Search Report for DE102010061215, Feb. 7, 2013.
German Search Report for DE102010061346, Sep. 30, 2011.
German Search Report for DE102010061343, Jul. 7, 2011.
German Search Report for DE102011053666, Oct. 21, 2011.
German Search Report for DE102013103264, Jul. 12, 2013.
Ishihara et al., JP 11155792 A, English Machine Translation, 1999, pp. 1-14.
German Search Report for Counterpart DE102014101260.7, Sep. 18, 2014.

* cited by examiner

DISHWASHER WITH FILTER ASSEMBLY

CROSS REFERENCE TO RELATED APPLICATIONS

The present application is a divisional application of U.S. patent application Ser. No. 13/164,542, filed Jun. 20, 2011, currently allowed, which application is a continuation-in-part of U.S. patent application Ser. No. 13/108,026, filed May 16, 2011, pending, both of which are incorporated by reference in their entirety.

BACKGROUND OF THE INVENTION

Contemporary dishwashers have a wash chamber in which utensils are placed to be washed according to an automatic cycle of operation. Water, alone, or in combination with a treating chemistry, forms a wash liquid that is sprayed onto the utensils during the cycle of operation. The wash liquid may be recirculated onto the utensils during the cycle of operation. A filter may be provided to remove soil particles from the wash liquid.

SUMMARY OF THE INVENTION

The invention relates to a dishwasher having a tub at least partially defining a treating chamber, a liquid spraying system supplying a spray of liquid to the treating chamber, a liquid recirculation system recirculating the sprayed liquid from the treating chamber to the liquid spraying system to define a recirculation flow path, a rotating filter having an upstream surface and a downstream surface and located within the recirculation flow path such that the recirculation flow path passes through the filter from the upstream surface to the downstream surface to effect a filtering of the sprayed liquid, a first artificial boundary spaced from and rotating relative to one of the downstream and upstream surfaces to form an increased shear force zone therebetween wherein liquid passing between the first artificial boundary and the filter applies a greater shear force on the at least one of the downstream and upstream surfaces than liquid in an absence of the first artificial boundary, and a drive system operably coupled to the filter and the first artificial to effect their relative rotation.

DESCRIPTION OF EMBODIMENTS OF THE INVENTION

Figure 1:
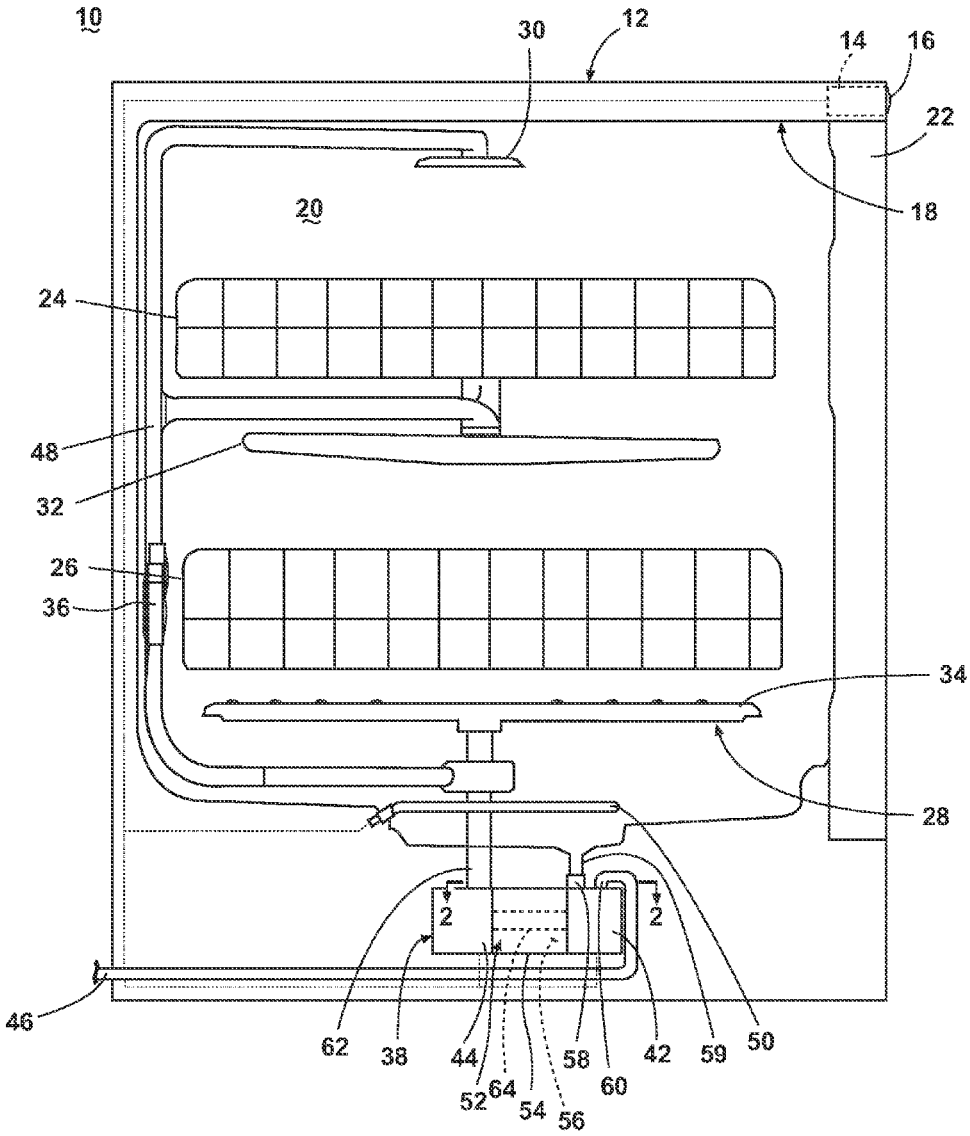
FIG. 1 is a schematic view of a dishwasher with a filter assembly according to a first embodiment of the invention.

Referring to FIG. 1, a first embodiment of the invention is illustrated as an automatic dishwasher 10 having a cabinet 12 defining an interior. Depending on whether the dishwasher 10 is a stand-alone or built-in, the cabinet 12 may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi tub dishwashers, or drawer-type dishwashers.

A controller 14 may be located within the cabinet 12 and may be operably coupled to various components of the dishwasher 10 to implement one or more cycles of operation. A control panel or user interface 16 may be provided on the dishwasher 10 and coupled to the controller 14. The user interface 16 may include operational controls such as dials, lights, switches, and displays enabling a user to input commands, such as a cycle of operation, to the controller 14 and receive information.

A tub 18 is located within the cabinet 12 and at least partially defines a treating chamber 20, with an access opening in the form of an open face. A cover, illustrated as a door 22, may be hingedly mounted to the cabinet 12 and may move between an opened position, wherein the user may access the treating chamber 20, and a closed position, as shown in FIG. 1, wherein the door 22 covers or closes the open face of the treating chamber 20.

Utensil holders in the form of upper and lower racks 24, 26 are located within the treating chamber 20 and receive utensils for being treated. The racks 24, 26 are mounted for slidable movement in and out of the treating chamber 20 for ease of loading and unloading. As used in this description, the term "utensil(s)" is intended to be generic to any item, single or plural, that may be treated in the dishwasher 10, including, without limitation: dishes, plates, pots, bowls, pans, glassware, and silverware. While not shown, additional utensil holders, such as a silverware basket on the interior of the door 22, may also be provided.

A spraying system 28 may be provided for spraying liquid into the treating chamber 20 and is illustrated in the form of an upper sprayer 30, a mid-level sprayer 32, a lower rotatable spray arm 34, and a spray manifold 36. The upper sprayer 30 may be located above the upper rack 24 and is illustrated as a fixed spray nozzle that sprays liquid downwardly within the treating chamber 20. Mid-level rotatable sprayer 32 and lower rotatable spray arm 34 are located, respectively, beneath upper rack 24 and lower rack 26 and are illustrated as rotating spray arms. The mid-level spray arm 32 may provide a liquid spray upwardly through the bottom of the upper rack 24. The lower rotatable spray arm 34 may provide a liquid spray upwardly through the bottom of the lower rack 26. The mid-level rotatable sprayer 32 may optionally also provide a liquid spray downwardly onto the lower rack 26, but for purposes of simplification, this will not be illustrated herein.

The spray manifold 36 may be fixedly mounted to the tub 18 adjacent to the lower rack 26 and may provide a liquid spray laterally through a side of the lower rack 26. The spray manifold 36 may not be limited to this position; rather, the spray manifold 36 may be located in virtually any part of the treating chamber 20. While not illustrated herein, the spray manifold 36 may include multiple spray nozzles having apertures configured to spray liquid towards the lower rack 26. The spray nozzles may be fixed or rotatable with respect to the tub 18. Suitable spray manifolds are set forth in detail in U.S. Pat. No. 7,445,013, issued Nov. 4, 2008, and titled "Multiple Wash Zone Dishwasher," and U.S. Pat. No. 7,523,758, issued Apr. 28, 2009, and titled "Dishwasher Having Rotating Zone Wash Sprayer," both of which are incorporated herein by reference in their entirety.

A liquid recirculation system may be provided for recirculating liquid from the treating chamber 20 to the spraying system 28. The recirculation system may include a pump assembly 38. The pump assembly 38 may include both a drain pump 42 and a recirculation pump 44. While not shown, a liquid supply system may include a water supply conduit coupled with a household water supply for supplying water to the treating chamber 20.

The drain pump 42 may draw liquid from a lower portion of the tub 18 and pump the liquid out of the dishwasher 10 to a household drain line 46. The recirculation pump 44 may draw liquid from a lower portion of the tub 18 and pump the liquid to the spraying system 28 to supply liquid into the treating chamber 20.

As illustrated, liquid may be supplied to the spray manifold 36, mid-level rotatable sprayer 32, and upper sprayer 30 through a supply tube 48 that extends generally rearward from the recirculation pump 44 and upwardly along a rear wall of the tub 18. While the supply tube 48 ultimately supplies liquid to the spray manifold 36, the mid-level rotatable sprayer 32, and upper sprayer 30, it may fluidly communicate with one or more manifold tubes that directly transport liquid to the spray manifold 36, the mid-level rotatable sprayer 32, and the upper sprayer 30. The sprayers 30, 32, 34, 36 spray treating chemistry, including only water, onto the dish racks 24, 26 (and hence any utensils positioned thereon). The recirculation pump 44 recirculates the sprayed liquid from the treating chamber 20 to the liquid spraying system 28 to define a recirculation flow path. While not shown, a liquid supply system may include a water supply conduit coupled with a household water supply for supplying water to the treating chamber 20.

A heating system having a heater 50 may be located within or near a lower portion of the tub 18 for heating liquid contained therein.

A liquid filtering system 52 may be fluidly coupled to the recirculation flow path for filtering the recirculated liquid and may include a housing 54 defining a sump or filter chamber 56 for collecting liquid supplied to the tub 18. As illustrated, the housing 54 may be physically separate from the tub 18 and may provide a mounting structure for the recirculation pump 44 and drain pump 42. The housing 54 has an inlet port 58, which is fluidly coupled to the treating chamber 20 through a conduit 59 and an outlet port 60, which is fluidly coupled to the drain pump 42 such that the drain pump 42 may effect a supplying of liquid from the filter chamber 56 to the household drain line 46. Another outlet port 62 extends upwardly from the recirculation pump 44 and is fluidly coupled to the liquid spraying system 28 such that the recirculation pump 44 may effect a supplying of the liquid to the sprayers 30, 32, 34, 36. A filter element 64, shown in phantom, has been illustrated as being located within the housing 54 between the inlet port 58 and the recirculation pump 44.

Figure 2:
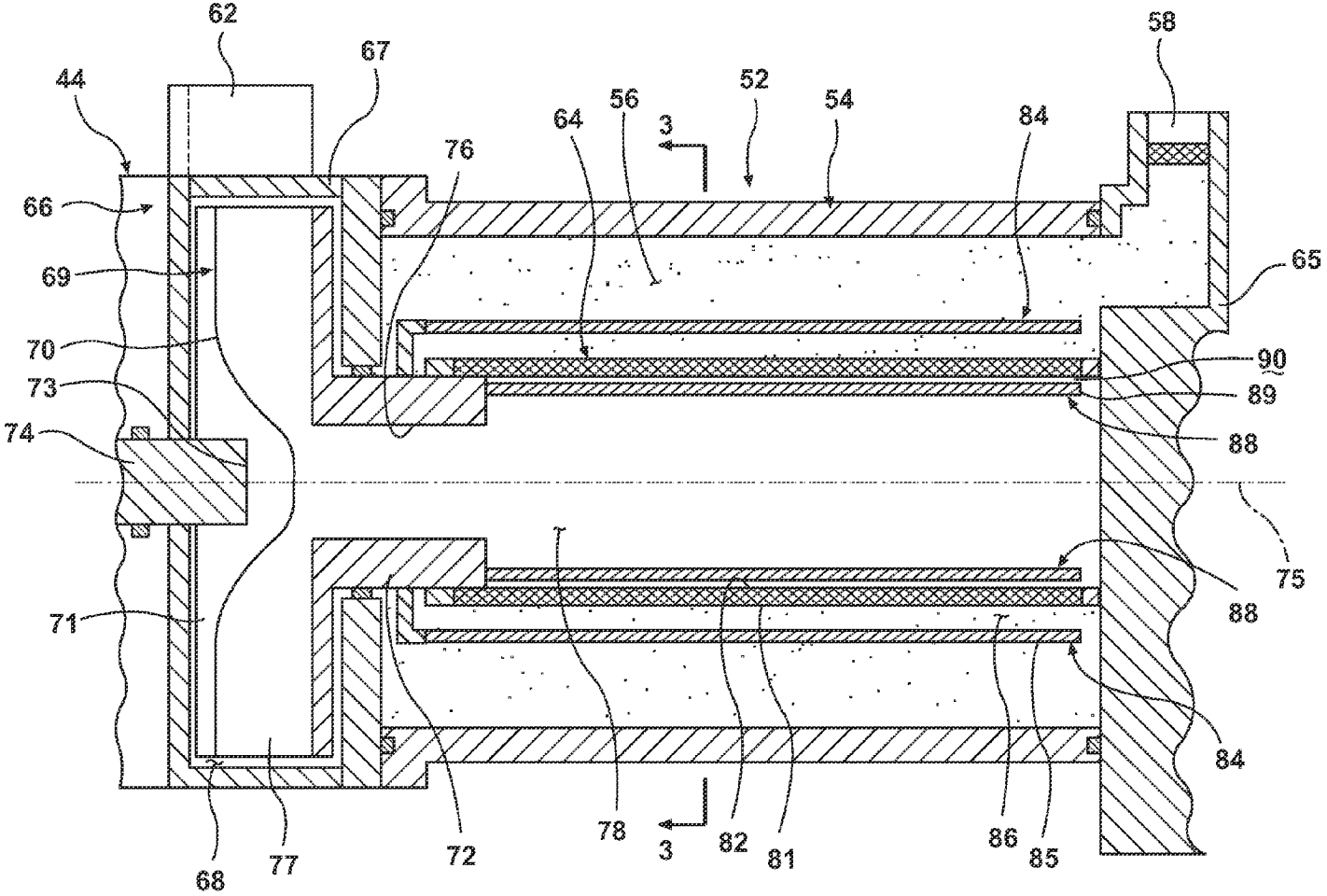
FIG. 2 is a cross-sectional view of the filter assembly and a portion of a recirculation pump of FIG. 1 taken along the line 2-2 shown in FIG. 1.

Referring now to FIG. 2, a cross-sectional view of the liquid filtering system 52 and a portion of the recirculation pump 44 is shown. The housing 54 has been illustrated as a hollow cylinder, which extends from an end secured to a manifold 65 to an opposite end secured to the recirculation pump 44. The inlet port 58 is illustrated as extending upwardly from the manifold 65 and is configured to direct liquid from a lower portion of the tub 18 into the filter chamber 56. The recirculation pump 44 is secured at the opposite end of the housing 54 from the inlet port 58.

The recirculation pump 44 includes a motor 66 (only partially illustrated in FIG. 2) secured to a pump housing 67, which as illustrated is cylindrical, but can be any suitable shape. One end of the pump housing 67 is secured to the motor 66 while the other end is secured to the housing 54. The pump housing 67 defines an impeller chamber 68 that fills with fluid from the filter chamber 56. The outlet port 62 is coupled to the pump housing 67 and opens into the impeller chamber 68.

The recirculation pump 44 also includes an impeller 69. The impeller 69 has a shell 70 that extends from a back end 71 to a front end 72. The back end 71 of the shell 70 is positioned in the chamber 68 and has a bore 73 formed therein. A drive shaft 74, which is rotatably coupled to the motor 66, is received in the bore 73. The motor 66 acts on the drive shaft 74 to rotate the impeller 69 about an axis 75. The motor 66 is connected to a power supply (not shown), which provides the electric current necessary for the motor 66 to spin the drive shaft 74 and rotate the impeller 69. The front end 72 of the impeller shell 70 is positioned in the filter chamber 56 of the housing 54 and has an inlet opening 76 formed in the center thereof, which fluidly couples to the filter chamber 56. The shell 70 has a number of vanes 77 that extend away from the inlet opening 76 to an outer edge of the shell 70.

The filter element 64 may be a filter screen enclosing a hollow interior 78. The filter screen is illustrated as cylindrical, but can be any suitable shape. The filter 64 may be made from any suitable material. The filter 64 may extend along the length of the housing 54 and being secured to the manifold 65 at a first end. The second end is illustrated as being adjacent the front end 72 of the impeller shell 70. This interface may include a seal to prevent unfiltered water from passing into the hollow interior 78. Although the filter 64 has been described as being rotationally fixed it has been contemplated that it may be rotated as set forth in detail in U.S. patent application Ser. No. 12/966,420, filed Dec. 13, 2010, and titled "Rotating Filter for a Dishwashing Machine," and U.S. patent application Ser. No. 12/910,203, filed Oct. 22, 2010, and titled "Rotating Drum Filter for a Dishwashing Machine," which are incorporated herein by reference in their entirety.

The filter 64 is illustrated as having an upstream surface 81 and a downstream surface 82 and divides the filter chamber into two parts. As wash fluid and removed soil particles enter the filter chamber 56 through the inlet port 58, a mixture of fluid and soil particles is collected in the filter chamber 56 in a region external to the filter 64. Because the filter 64 allows fluid to pass into the hollow interior 78, a volume of filtered fluid is formed in the hollow interior 78. In this manner, recirculating liquid passes through the filter 64 from the upstream surface 81 to the downstream surface 82 to effect a filtering of the liquid. In the described flow direction, the upstream surface 81 correlates to an outer surface of the filter 64 and the downstream surface 82 correlates to an inner surface of the filter 64 such that the filter 64 separates the upstream portion of the filter chamber 56 from the outlet port 62. If the flow direction is reversed, the downstream surface may correlate with the outer surface and the upstream surface may correlate with the inner surface.

A passageway (not shown) fluidly couples the outlet port 60 of the manifold 65 with the filter chamber 56. When the drain pump 42 is energized, fluid and soil particles from a lower portion of the tub 18 pass downwardly through the inlet port 58 into the filter chamber 56. Fluid then advances from the filter chamber 56 through the passageway without going through the filter element 64 and advances out the outlet port 60.

Two first artificial boundaries or flow diverters 84 are illustrated as being positioned in the filter chamber 56 externally of the filter 64. Each of the first flow diverters 84 has been illustrated as including a body 85 that is spaced from and overlies a different portion of the upstream surface 81 to form a gap 86 therebetween. Each body 85 is illustrated as being operably coupled with the front end 72 of the impeller shell 70. As such, the first diverters 84 are operable to rotate about the axis 75 with the impeller 69.

Two second flow diverters 88 are illustrated as being positioned within the hollow interior 78. Each of the second flow diverters 88 has been illustrated as including a body 89, which is spaced from and overlies a different portion of the downstream surface 82 to form a gap 90 therebetween. Each body 89 may also be operably coupled with the front end 72 of the impeller shell 70 such that the second flow diverters 88 are also operable to rotate about the axis 75 with the impeller 69.

Figure 3:
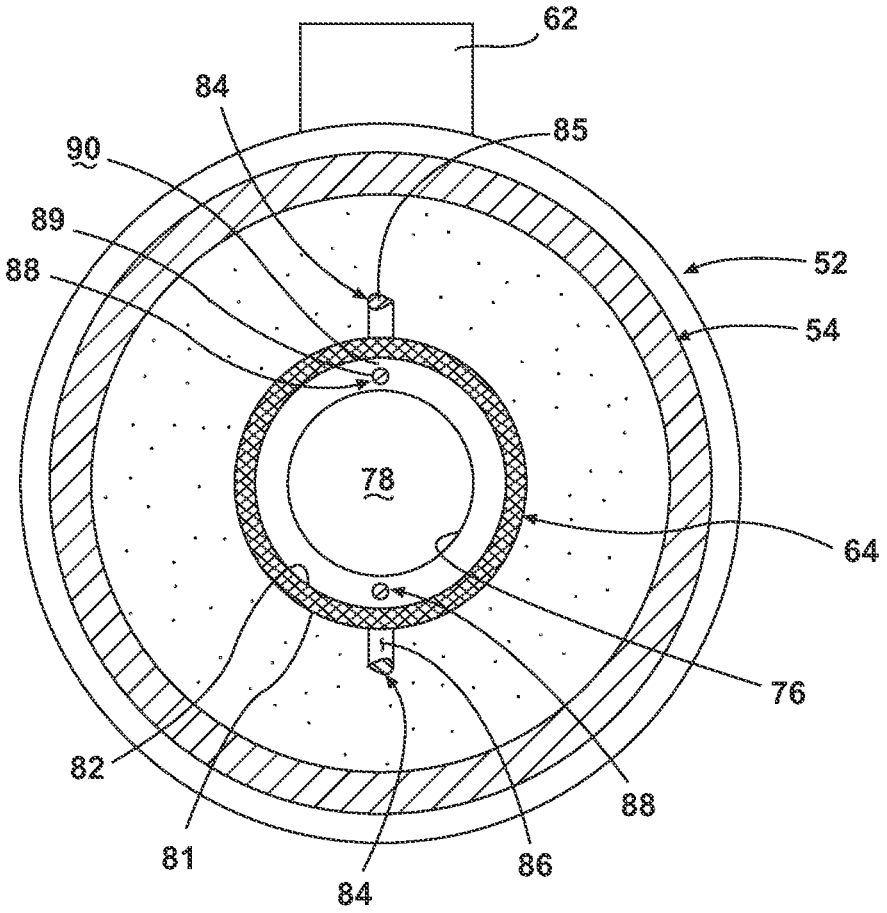
FIG. 3 is a cross-sectional view of the filter assembly of FIG. 2 taken along the line 3-3 shown in FIG. 2.

As may more easily be seen in FIG. 3, the sets of first and second flow diverters 84, 88 are arranged relative to each other such that they are diametrically opposite each other relative to the filter 64. In this manner each of the first and second flow diverters 84, 88 are arranged to create a pair with the first flow diverter 84 of the pair rotating about the upstream surface 81 and the second flow diverter 88 of the pair rotating about the downstream surface 82. As each of the first flow diverters 84 and second flow diverters 88 are coupled with the impeller 69 and rotate with the impeller 69, each pair has a fixed rotational relationship with respect to each other. The first and second flow diverters 84, 88 of each pair are also rotationally spaced from each other. Further, it may be seen that each of the first flow diverters 84 are diametrically opposite each other and that each of the second flow diverters 88 are diametrically opposite each other. It has been contemplated that the first and second flow diverters 84, 88 may have alternative arrangements and spacing.

As illustrated, each of the first flow diverters 84 has an airfoil cross section while the second flow diverters 88 each have a circular cross section. It has been contemplated that all of the flow diverters 84, 88 may have the same cross section or that each may be different. Further, it has been contemplated that the first and second flow diverters 84, 88 may have any suitable alternative cross section.

During operation, the controller 14 operates various components of the dishwasher 10 to execute a cycle of operation. During such cycles a wash fluid, such as water and/or treating chemistry (i.e., water and/or detergents, enzymes, surfactants, and other cleaning or conditioning chemistry) may pass from the recirculation pump 44 into the spraying system 28 and then exits the spraying system 28 through the sprayers 30-36. After wash fluid contacts the dish racks 24, 26 and any utensils positioned in the treating chamber 20, a mixture of fluid and soil falls onto the bottom wall 40 and collects in a lower portion of the tub 18 and the filter chamber 56.

As the filter chamber 56 fills, wash fluid passes through the filter 64 into the hollow interior 78. The activation of the motor 66 causes the impeller 69 and the first and second flow diverters 84, 88 to rotate. The rotational speed of the impeller 69 may be controlled by the controller 14 to control a rotational speed of the first and second flow diverters 84, 88. The rotation of the impeller 69 draws wash fluid from the filter chamber 56 through the filter 64 and into the inlet opening 76. Fluid then advances outward along the vanes 77 of the impeller shell 70 and out of the chamber 68 through the outlet port 62 to the spraying system 28. When wash fluid is delivered to the spraying system 28, it is expelled from the spraying system 28 onto any utensils positioned in the treating chamber 20.

While fluid is permitted to pass through the filter 64, the size of the pores in the filter 64 prevents the soil particles of the unfiltered liquid from moving into the hollow interior 78. As a result, those soil particles may accumulate on the upstream surface 81 of the filter 64 and clog portions of the filter 64 preventing fluid from passing into the hollow interior 78.

The rotation of the first flow diverters 84 causes the unfiltered liquid and soil particles within the filter chamber 56 to rotate about the axis 75 with the first flow diverters 84. The flow diverters 84 divide the unfiltered liquid into a first portion which may flow through the gap 86, and a second portion, which bypasses the gap 86. The angular velocity of the fluid within each gap 86 increases relative to its previous velocity. As the filter 64 is stationary within the filter chamber 56, the liquid in direct contact with the upstream surface 81 of the filter 64 is also stationary or has no rotational speed. The liquid in direct contact with the first flow diverters 84 has the same angular speed as each of the first flow diverters 84, which is generally in the range of 3000 rpm and may vary between 1000 to 5000 rpm. The speed of rotation is not limiting to the invention. Thus, the liquid in the gaps 86 between the upstream surface 81 and the first flow diverters 84 has an angular speed profile of zero where it is constrained at the filter 64 to approximately 3000 rpm where it contacts each of the first flow diverters 84. This requires substantial angular acceleration, which locally generates a shear force acting on the upstream surface 81. Thus, the proximity of the first flow diverters 84 to the filter 64 causes an increase in the angular velocity of the liquid within the gap 86 and results in a shear force being applied to the upstream surface 81.

As the second flow diverters 88 also rotate with the impeller 69, the liquid in the gaps 90 between the downstream surface 82 and the second flow diverters 88 also has an angular speed profile of zero where it is constrained at the filter 64 to approximately 3000 rpm where it contacts each of the second flow diverters 88. This creates a substantial angular acceleration of the liquid within the gaps 90 and generates shear forces that act on the downstream surface 82.

The applied shear forces aid in the removal of soils from the filter 64 and are attributable to the rotating first and second flow diverters 84, 88 and the interaction of the liquid within the gaps 86, 90. The increased shear forces function to remove soils which may be clogging the filter 64 and/or preventing soils from being trapped on the filter 64. The shear forces act to "scrape" soil particles from the filter 64 and aid in cleaning the filter 64 and permitting the passage of fluid through the filter 64 into the hollow interior 78 to create a filtered liquid.

It has been contemplated that the first and second flow diverters may also aid in the creation of a nozzle or jet-like flow through the filter 64 and/or a backflow effect. That is, the first and second flow diverters 84, 88 may have various shapes and orientations, which will in turn have varying impacts on the fluid within the filter chamber 56 as set forth in detail in U.S. patent application Ser. No. 12/966,420, filed Dec. 13, 2010, and titled "Rotating Filter for a Dishwashing Machine," which is incorporated herein by reference in its entirety.

Figure 4:
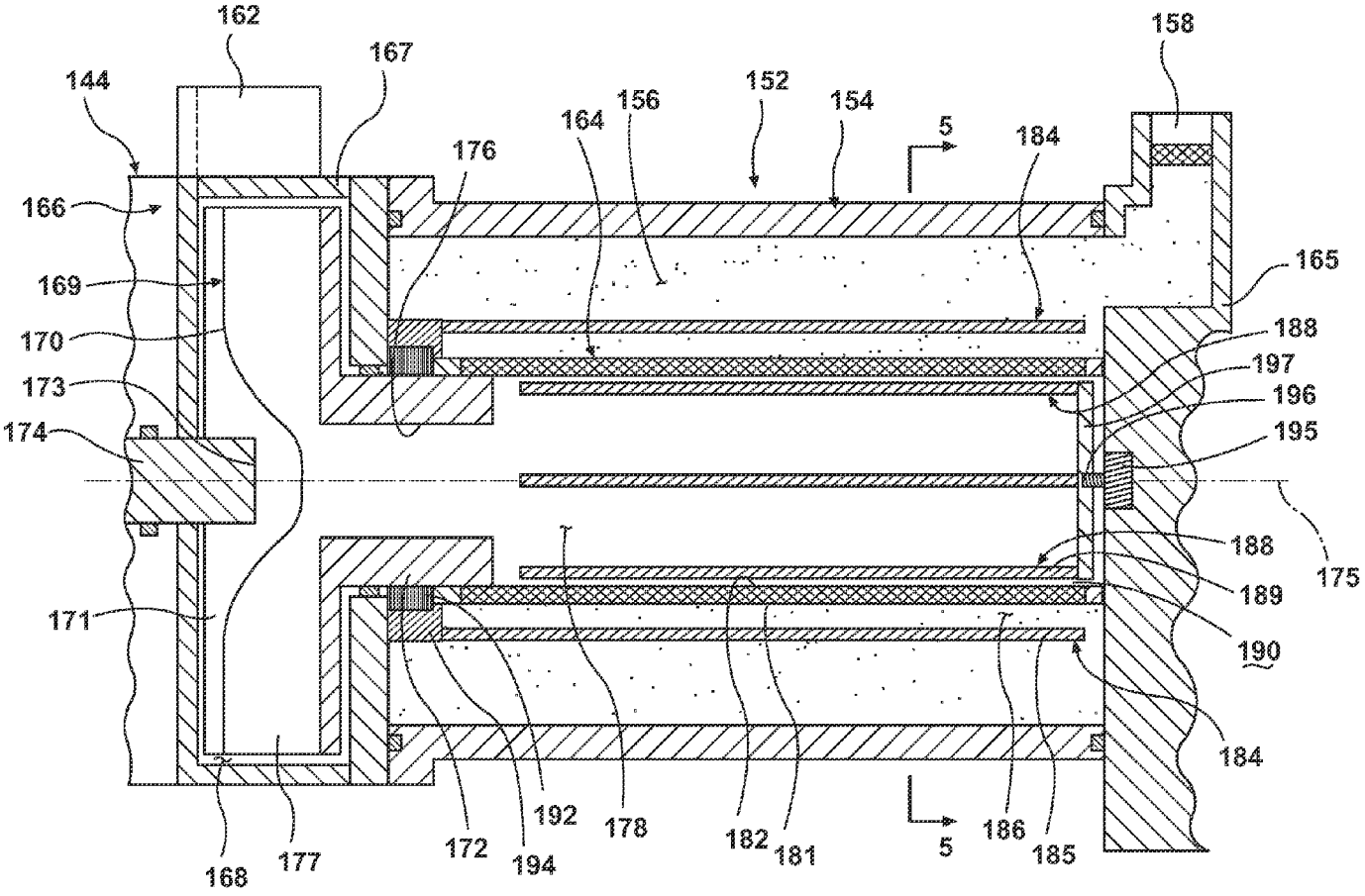
FIG. 4 is a cross-sectional view of a second embodiment of a filter assembly, which may be used in the dishwasher of FIG. 1.

FIG. 4 illustrates a liquid filtering system 152 and a portion of a recirculation pump 144 according to a second embodiment of the invention, which may be used in the dishwasher 10. The second embodiment is similar to the first embodiment; therefore, like parts will be identified with like numerals increased by 100, with it being understood that the description of the like parts of the first embodiment applies to the second embodiment, unless otherwise noted.

One difference between the second embodiment and the first embodiment is that the filtering system 152 includes a clutch assembly 192 to selectively operably couple the first flow diverters 184 to the front end 172 of the impeller shell 170 such that the first flow diverters 184 may be selectively rotatably driven by engagement of the clutch assembly 192. More specifically, when the clutch assembly 192 is engaged by the controller 14, the clutch assembly 192 operably couples the front end 172 of the impeller shell 170 to the first flow diverters 184 such that the first flow diverters 184 are operable to rotate about the axis 175 with the impeller 169. When the clutch assembly 192 is disengaged the impeller 169 rotates without co-rotation of the first flow diverters 184. The type and configuration of the clutch assembly 192 is not germane to the invention. Any suitable clutch mechanism be it centrifugal, hydraulic, electromagnetic, viscous, for example, may be used.

Further, a speed adjuster 194 is illustrated as operably coupling the impeller 169 to the first flow diverters 184 such that the rotation of the first flow diverters 184 about the upstream surface 181 may be at a speed that is different than the speed of the impeller 169. It is contemplated that the speed adjuster 194 may be either a speed reducer to rotate the first flow diverters 184 at a slower speed than the impeller 169 or a speed increaser to rotate the first flow diverters 184 at a speed faster than the impeller 169. By way of a non-limiting example, a speed reducer may include a reduction gear assembly, which may convert the rotation of the impeller 169 into a slower rotation of the first flow diverters 184. Further, it is contemplated that the speed adjuster 194 may allow for the first flow diverters 184 to be driven at variable speeds. By way of a non-limiting example, such a variable speed adjuster may include a transmission assembly operably coupled to the controller 14.

Yet another difference between the second embodiment and the first embodiment is that a motor 195 is illustrated as being operably coupled to the second flow diverters 188. More specifically, a drive shaft 196, which is rotatably coupled to the motor 195, is received in a base 197, which is operably coupled to the second flow diverters 188. The motor 195 may be operably coupled to the controller 14 such that when it is actuated it acts on the drive shaft 196 to rotate the base 197 and second flow diverters about the axis 175. The motor 195 is connected to a power supply (not shown), which provides the electric current necessary for the motor 195 to spin the drive shaft 196 and rotate the base 197 and second flow diverters 188. The motor 195 may be a variable speed motor such that the second flow diverters 188 may be rotated at various predetermined speeds.

Figure 5:
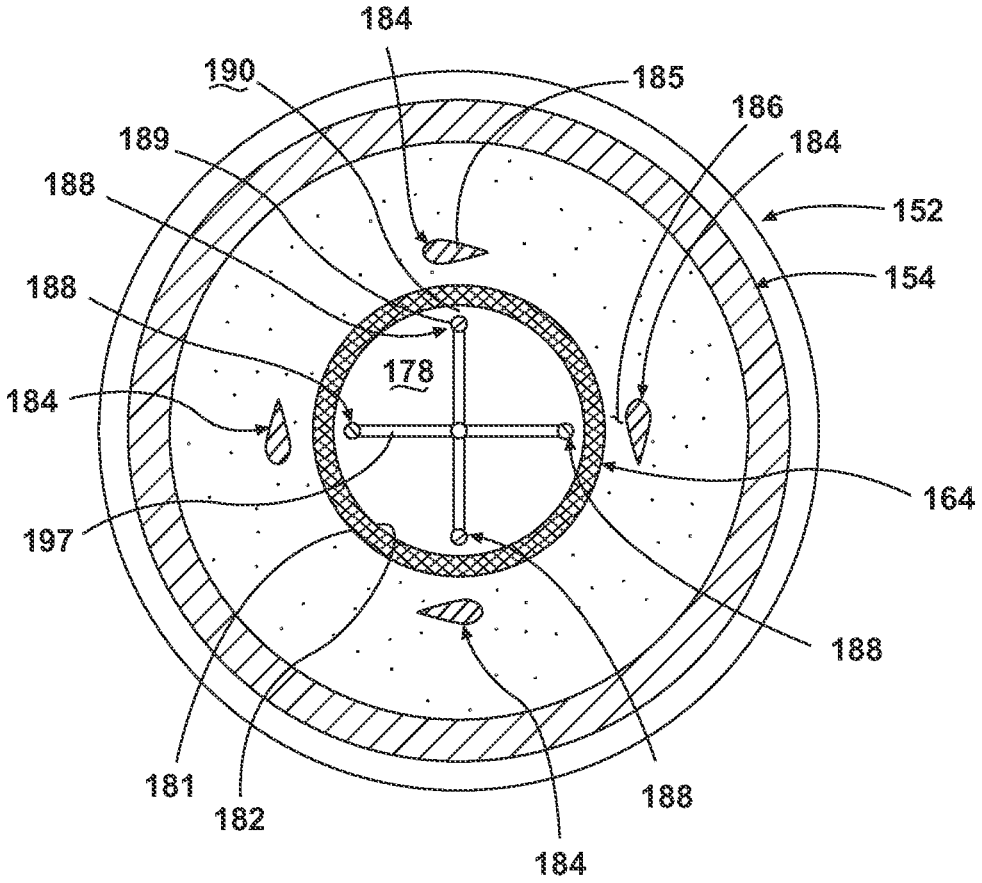
FIG. 5 is a cross-sectional view of the filter assembly of FIG. 4 taken along the line 5-5 shown in FIG. 4.

As may more easily be seen in FIG. 5 another difference between the second embodiment and the first embodiment is that the first flow diverters 184 include four first flow diverters 184 and the second flow diverters 188 include four second flow diverters 188. Further, the bodies 185 of the first flow diverters 184 are larger than those illustrated in the first embodiment. It has been contemplated that the first and second flow diverters 184, 188 may have any suitable size and formation.

The second embodiment operates much the same way as the first embodiment. That is, during operation of the dishwasher 10, liquid is recirculated and sprayed by the spraying system 28 into the treating chamber 20 and then flows to the liquid filtering system 52. Activation of the motor 166 causes the impeller 169 to rotate and recirculates the liquid.

While the liquid is being recirculated, the filter 164 may begin to clog with soil particles. As the impeller is rotated, the first flow diverters 184 may also be rotating if the clutch 192 is engaged. If the clutch 192 is not currently engaged, the controller 14 may engage the clutch 192 such that the first flow diverters 184 begin to rotate. Further, the speed of rotation of the first flow diverters 184 may be adjusted by controlling the speed adjuster 194. At the same time, the motor 195 may also be controlled to cause rotation of the second flow diverters 188. It has been determined that based on a determined degree of clogging, the speed of the flow diverters 184, 188 may be increased. Mechanisms for determining a degree of clogging, such as a pressure sensor, motor torque sensor, flow meter, etc. are known in the prior art and are not germane to the invention.

As the speed of rotation of the first and second flow diverters 184, 188 is increased, the liquid traveling through the gaps 186, 190 also has an increased angular acceleration. The increase in the angular acceleration of the liquid creates an increased shear force, which is applied to the upstream surface 181 and the downstream surface 182, respectively. The increased shear force has a magnitude, which is greater than what would be applied if the first and second flow diverters 184, 188 were rotating at a slower speed or were not rotating at all.

This greater magnitude shear force aids in the removal of soils on the upstream surface 181 and the downstream surface 182 and is attributable to the interaction of the liquid traveling through the gaps 186, 190 and the rotation of the first and second flow diverters 184, 188. The increased shear force functions to remove soils that are trapped on the filter 164 and decreases the degree of clogging of the filter 164. Once the degree of clogging has been reduced, the controller 14 may control the speed reducer 194, clutch 192, or motor 195 such that the rotational movement of the first and second flow diverters 184, 188 is slowed or stopped.

Figure 6:
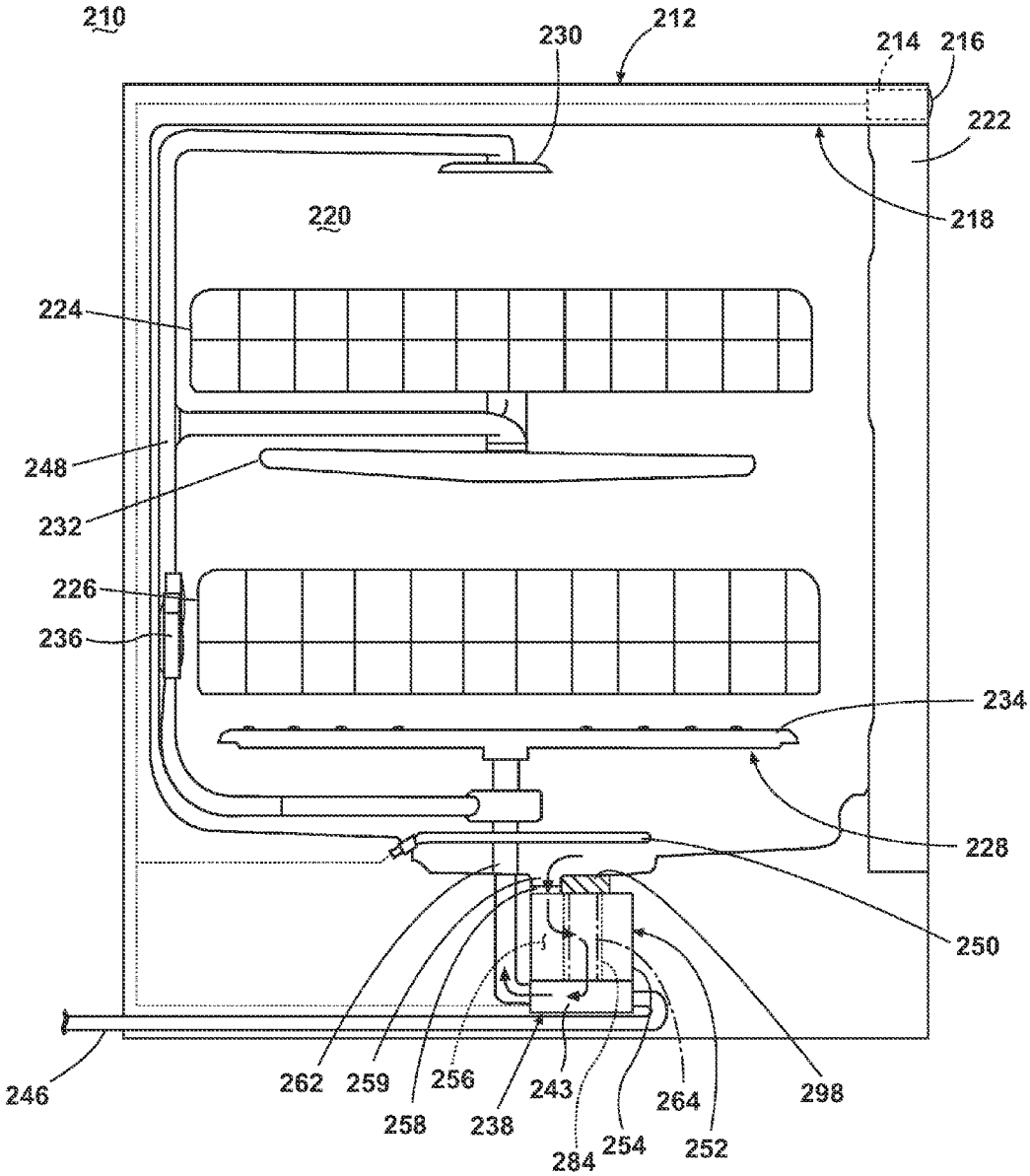
FIG. 6 is a schematic view of a dishwasher according to a third embodiment of the invention.

FIG. 6 illustrates a dishwasher 210 having a pump assembly 238 and filtering system 252 according to a third embodiment of the invention. The third embodiment is similar to the first embodiment; therefore, like parts will be identified with like numerals increased by 200, with it being understood that the description of the like parts of the first embodiment applies to the third embodiment, unless otherwise noted.

One difference between the third embodiment and the first embodiment is that the liquid filtering system 252 is oriented vertically such that a filter 264 is oriented vertically within a vertical housing 254. A further difference is that no flow diverters on the downstream side have been included and only flow diverters 284 on the upstream side of the filter 264 are used to create an increased shear force. As with the earlier embodiments, these flow diverters 284 may be operable to rotate about the filter 264.

Another difference between the third embodiment and the first embodiments is that the recirculation system has been illustrated as including a pump assembly 238, which includes a single pump 243 configured to selectively supply liquid to either the spraying system 228 or the drain line 246, such as by rotating the pump 243 in opposite directions. Alternatively, it has been contemplated that a suitable valve system (not shown) may be provided to selectively supply the liquid from the pump 243 to either the spraying system 228 or the drain line 246.

Further, a removable cover 298 has been illustrated as being flush with the bottom wall of the tub 218 and being operably coupled to the housing 254 such that it may seal the housing 254. Thus, the inlet 258 is the only liquid inlet into the housing 254. A user may remove the cover 298 to access the filter 264. It has been contemplated that the filter 264 may be removably mounted within the housing 254 such that once the cover 298 has been removed a user may remove the filter 264 to clean it. The user may then replace both the filter 264 and the cover 298 to again achieve a sealed filter chamber 256.

The third embodiment operates much the same way as the first embodiment. That is, during operation of the dishwasher 210, liquid is recirculated and sprayed by the spraying system 228 into the treating chamber 220. Activation of the pump 243 causes the impeller (not shown) and the flow diverters 284 to rotate and the liquid to be recirculated. More specifically, liquid that enters the housing 254 may be directed through the filter 264 and back into the treating chamber 220 as illustrated by the arrows. As with the earlier embodiment, the rotating flow diverters 284 may cause an increased shear force to be applied to the filter 264 to aid in its cleaning.

Figure 7:
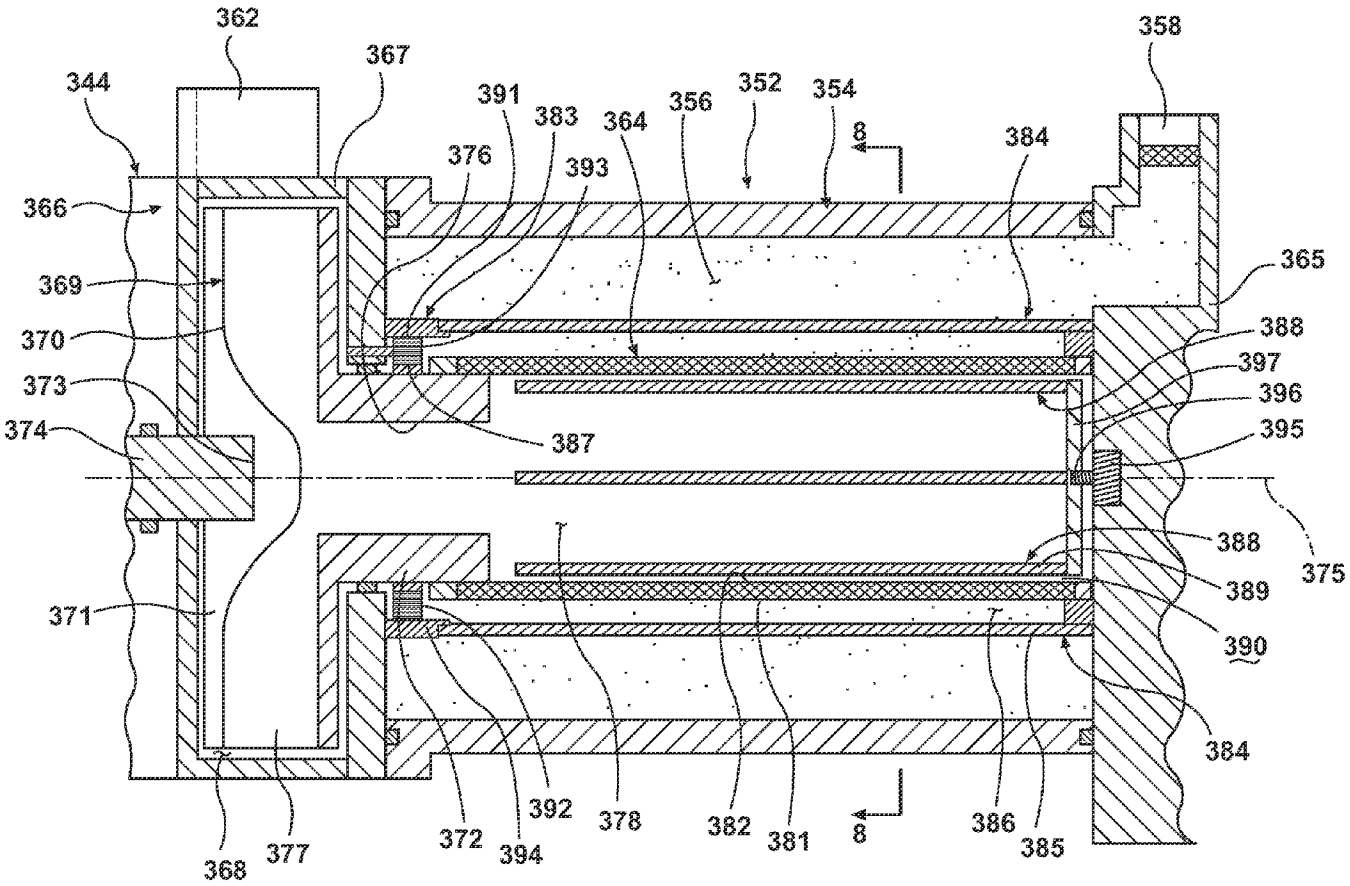
FIG. 7 is a cross-sectional view of a fourth embodiment liquid filtering system, which may be used in a dishwasher and illustrates a rotating filter in combination with inner and outer rotating diverters.

FIG. 7 illustrates a liquid filtering system 352, including a portion of the recirculation pump 344 according to a fourth embodiment of the invention, which may be used in any dishwasher, including dishwashers 10 and 210. In many ways the fourth embodiment is similar to the prior three embodiments; therefore, like parts will be identified with like numerals beginning in the 300 series, with it being understood that the description of the like parts of the prior embodiments applies to the fourth embodiment, unless otherwise noted.

The fourth embodiment differs in several ways from the prior embodiments. One way in which the fourth embodiment differs is that the filter 364 and first flow diverters 384 (also referred to as first artificial boundary 384) are configured for cooperative rotation in that the rotation of one rotates the other. As illustrated, the cooperative rotation is one of a counter rotation, but could easily be configured for co-rotation.

While many structures are possible to accomplish the counter rotation, as illustrated, the filter 364 is directly coupled to the impeller 369 and a gear assembly 383 rotationally couples the impeller 369 to the first flow diverters 384. The gear assembly 383 comprises a drive gear 387 provided on the impeller 369, which may be integrally formed with the impeller 369, a ring gear 391 mounting the first flow diverters 384, and an idler gear 393 coupling the drive gear 369 to the ring gear 391.

Figure 8:
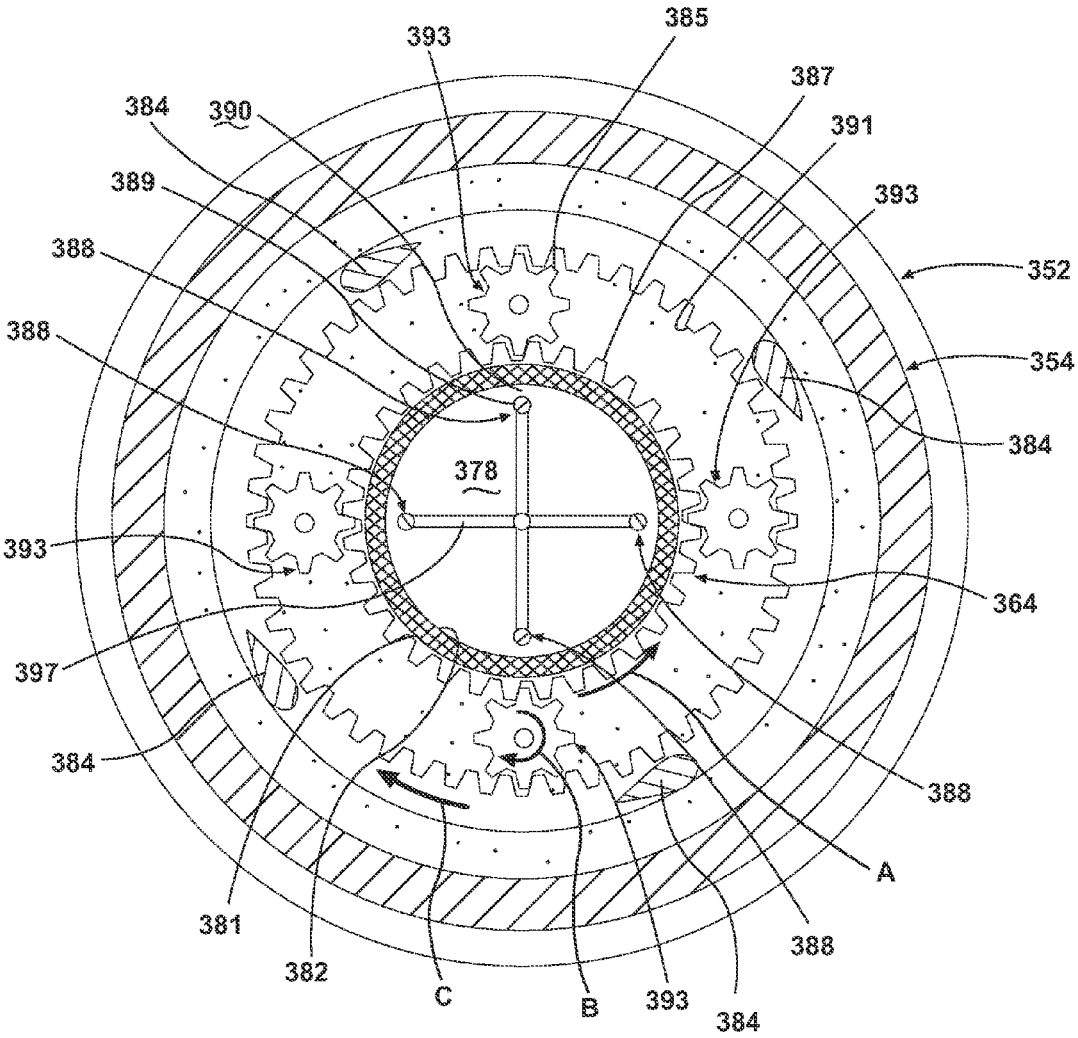
FIG. 8 is a cross-sectional view of the filter assembly of FIG. 7 taken along the line 8-8 shown in FIG. 7, with the diverters rotated to new position to better illustrate a gear assembly rotationally coupling at least some of the diverters with the rotating filter.

As better seen in FIG. 8, there may be multiple idler gears 393 located between the drive gear 387 and the ring gear 391, which define a planetary-type gear configuration. As can be seen by the rotation arrows A, B, C, the counter-clockwise rotation of the drive gear 387 results in a clockwise rotation of the ring gear 391, which results in a counter-rotation of the first flow diverters 384 relative to the filter 364.

The radius of any one or more of the drive gear 387, ring gear 391, and idler gear 393 may be selected to form any desired degree of gear reduction or gear increase between the drive gear 387 and the ring gear 391 to control the relative rotational speeds of the drive gear 387 and ring gear 391, which provides for rotating the filter 364 and first flow diverters 384 at different rotational speeds in addition to different rotational directions. Gear assemblies may be used that are different than those disclosed, including gear trains and/or belt drive systems that provide for on-the-fly varying of the relative rotational speeds.

With the illustrated configuration, a drive system is formed for counter-rotating the filter 364 and the first flow diverters 384, with the drive system having two drive units: one for the filter 364 and another for the first flow diverters 384. The impeller 369 performs the function of the drive unit for the filter 364 and the impeller 369 in combination with the gear assembly forms the drive unit for the first flow diverters 384.

It is noted that a motor 395 is used to rotate the second flow diverters 388. Similarly, a separate motor could be used to rotate the idler gear 393 to drive the ring gear 391 and rotate the first flow diverters 384. Additionally, a stacked arrangement of idler gears 393 could be used for co-rotation of the first and second flow diverters 384, 388 with the filter 364. Alternatively, it is contemplated that other drive mechanisms such as a fluid drive or a turbine may be operably coupled to the second flow diverter 388 and used to drive the second flow diverter 388.

One benefit of counter rotating the filter 364 and the first flow diverters 384 is that each can be rotated at a lower speed to accomplish the same relative speed difference. Thus, the same magnitude of shear force may be created at lower actual rotational speeds, which means that a smaller pump motor may be used. Another benefit is that it is contemplated that less noise will be produced at the lower speeds.

Figure 9:
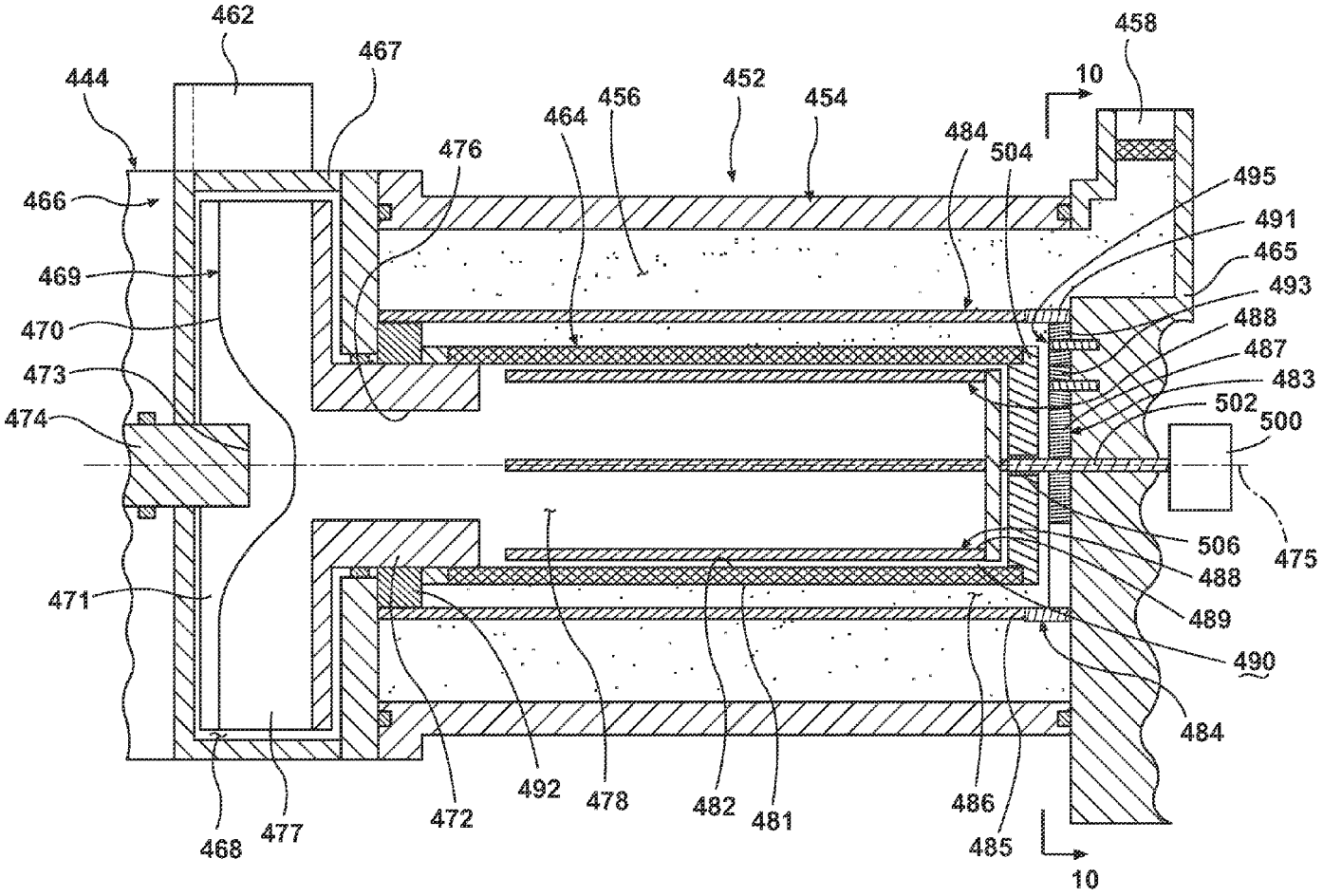
FIG. 9 is a cross-sectional view of a fifth embodiment liquid filtering system, which may be used in a dishwasher and illustrates a rotating filter in combination with inner and outer rotating diverters.

FIG. 9 illustrates a liquid filtering system 452, including a portion of the recirculation pump 444 according to a fifth embodiment of the invention, which may be used in any dishwasher, including dishwashers 10 and 210. In many ways, the fifth embodiment is similar to the prior four embodiments; therefore, like parts will be identified with like numerals beginning in the 400 series, with it being understood that the description of the like parts of the prior embodiments applies to the fifth embodiment, unless otherwise noted. The fifth embodiment differs from the other embodiments in that the first and second flow diverters 484, 488 are driven by a motor 500 directly coupled to the second flow diverters 488 through a drive shaft 502, with a gear assembly 483 coupling the drive shaft 502 to the first flow diverters 484. The filter 464 is directly coupled to the impeller 469. With this configuration, the first and second flow diverters 484, 488 are co-rotated with the filter 464 and independently rotated of the filter 464.

Figure 10:
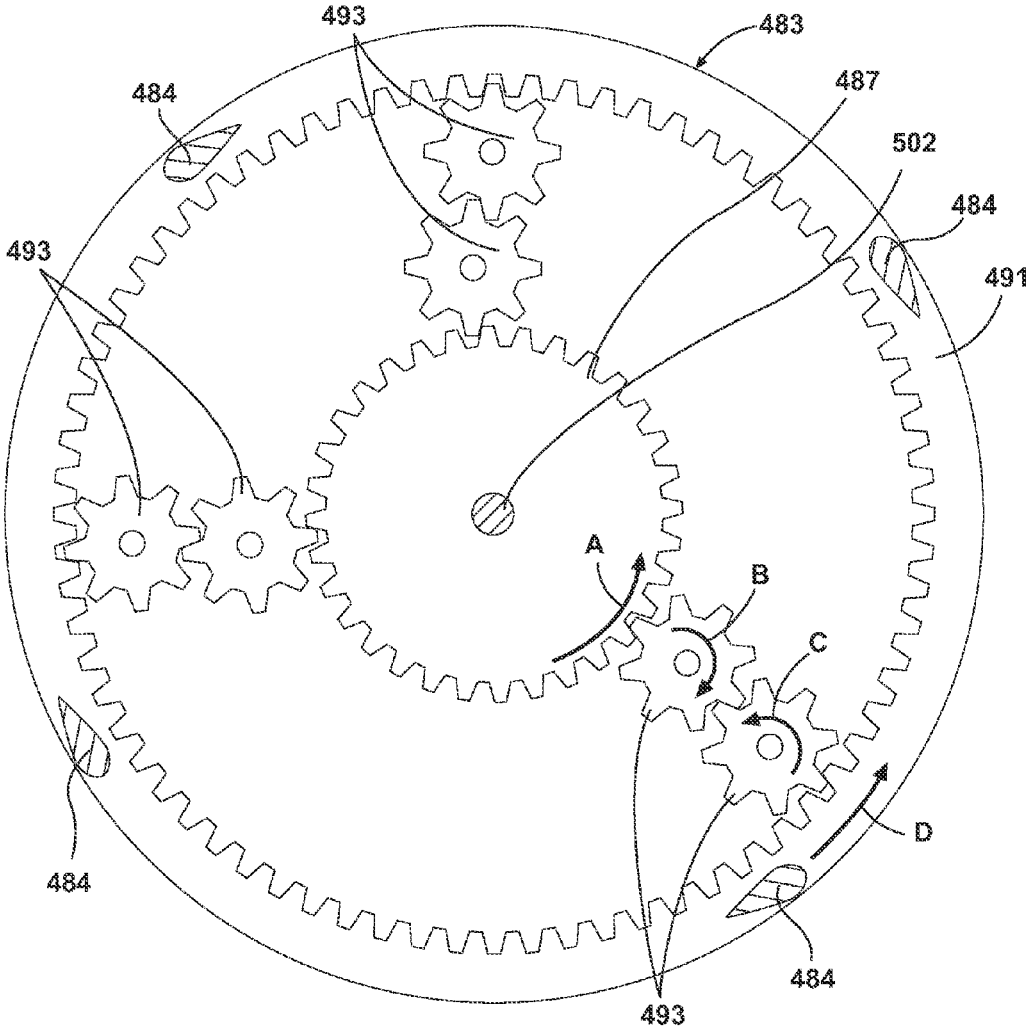
FIG. 10 is a cross-sectional view of the filter assembly of FIG. 9 taken along the line 10-10 shown in FIG. 9.

Referring to FIG. 10, the gear assembly 483 is illustrated as a drive gear 487, ring gear 491, and stacked idler gears 493. As can be seen by the rotation arrows A, B, C, and D, the stacking of the idler gears 493 results in the first and second flow diverters 484, 488 rotating in the same direction. If counter rotation of the first and second flow diverters 484, 488 is desired, only a single idler gear need be used.

As with the fourth embodiment, the radius of any one or more of the drive gear 487, ring gear 491, and idler gears 493 may be selected to form any desired degree of gear reduction or gear increase between the drive gear 487 and the ring gear 491 to control the relative rotational speeds of the drive gear 487 and ring gear 491, which provides for rotating the first and second flow diverters 484, 488 at different rotational speeds. Other gear assemblies may be used other than those disclosed, including gear trains and/or belt drive systems that provide for on-the-fly varying of the relative rotational speeds.

It is noted that the filter 464 terminates in an end cap 504, which houses a bearing 506 that receives the drive shaft 502.

Thus, the end cap 504 is rotatably supported on the drive shaft 502 instead of on the surrounding manifold 465.

In this configuration, the drive system effects a co-rotation of the filter 464 with the first and second flow diverters 484, 488, with the impeller 469 performing a drive unit function for the filter 464 and the motor 500 performing a drive unit function for the first and second flow diverters 484, 488.

Other configurations are possible for the co-rotation of at least one of the first and second flow diverters 484, 488 with the filter 464. For example, a suitable structure could project from the impeller 469 to directly support the first flow diverters 484, like in a hub and spoke configuration, with a portion of the impeller 469 forming the hub and spoke-like structures projecting therefrom to form the spokes. In such a configuration, the rotation speed of the first flow diverters 484 would be the same as the filter 464, which is not preferred because the first flow diverters 484 would always overly the same portion of the filter, which would limit the configuration to clearing only that portion of the filter. In such a configuration, the shape of the first flow diverter may need to be expanded to overly more of the filter.

Figure 11:
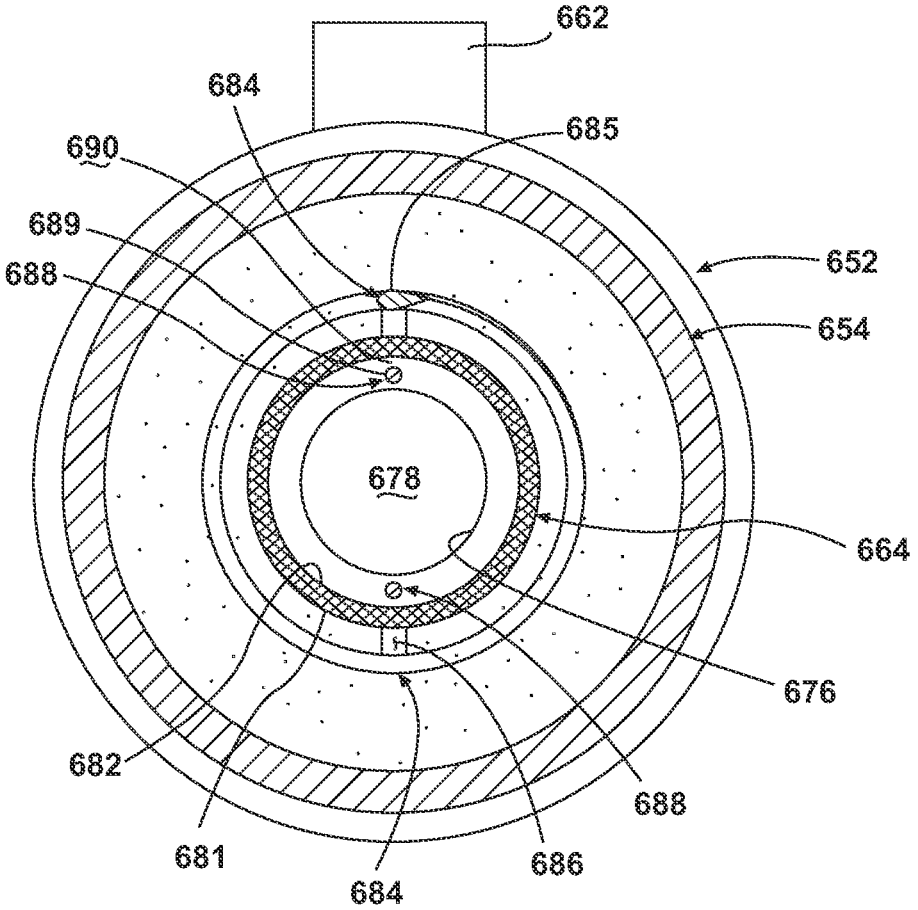
FIG. 11 is a cross-sectional view of a filter assembly according to a sixth embodiment of the invention.

FIG. 11 illustrates a liquid filtering system 652, including a portion of the recirculation pump 644 according to a sixth embodiment of the invention, which may be used in any dishwasher, including dishwashers 10 and 210, and may be used in place or in combination with any of the prior embodiments. In many ways, the sixth embodiment is similar to the prior five embodiments; therefore, like parts will be identified with like numerals beginning in the 600 series, with it being understood that the description of the like parts of the prior embodiments applies to the sixth embodiment, unless otherwise noted. The sixth embodiment differs from the other embodiments in that the first and second flow diverters 684, 688 (also referred to as artificial boundaries) are not matched in that the general shapes of the first and second flow diverters differ, which is made possible by the fact that the first and second flow diverters may rotate relative to each other. Relative rotation of the first and second flow diverters 684, 688 may be controlled to ensure there will be times when the first and second flow diverters 684, 688 overlie each other and generate the desired shear force and resulting shear zone.

Figure 12:
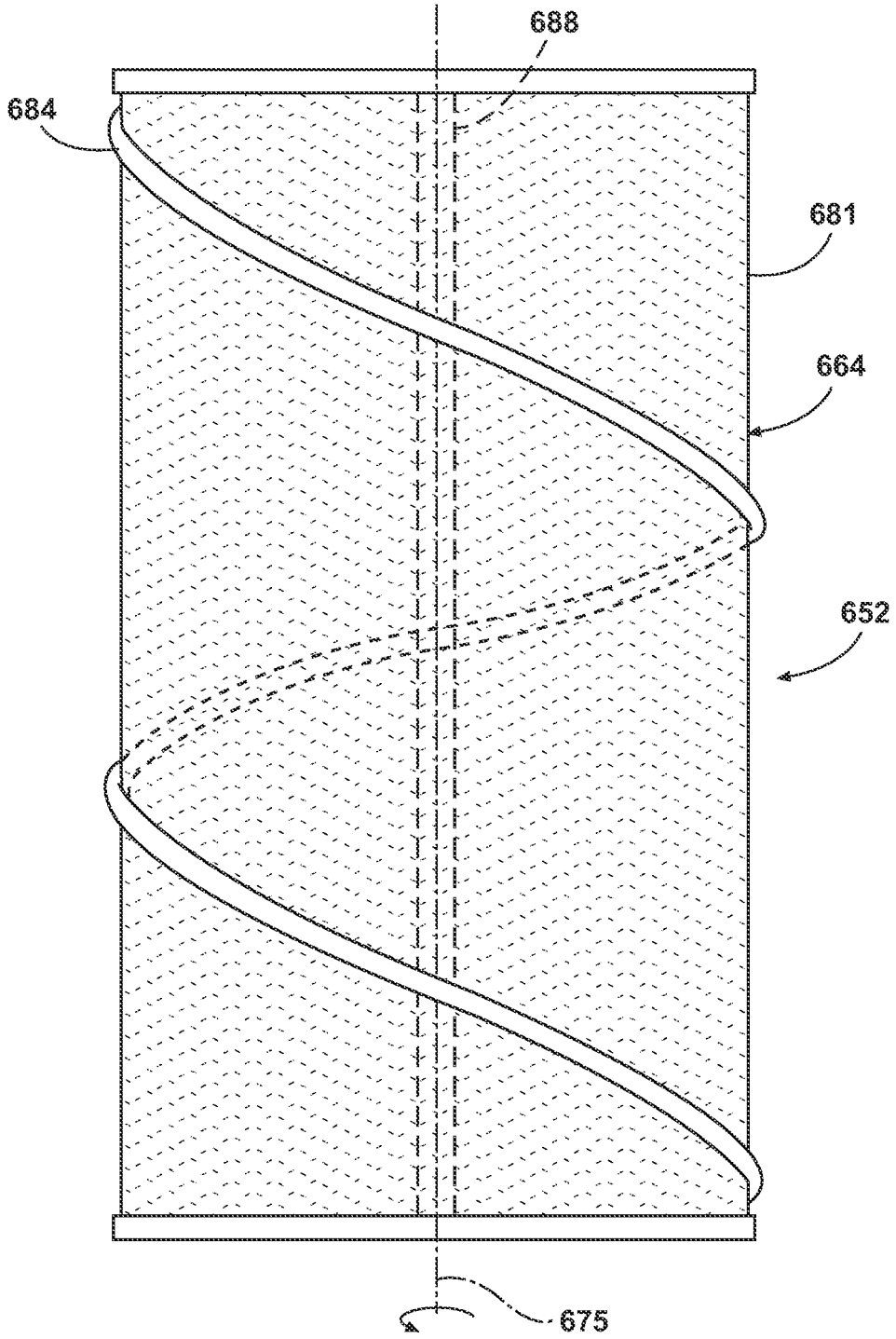
FIG. 12 is a top view of the filter assembly of FIG. 11 with the surrounding housing removed for clarity.

Referring to FIG. 12, it can be seen that the first flow diverter 684 has a helical shape that winds around the filter 664 and the second flow diverter 688 has a linear shape. The second flow diverter 688 is shown extending along the rotational axis 675, but it could alternatively be oriented at an angle relative to the rotational axis 675. The first flow diverter 684 is illustrated with an airfoil or tear-drop cross section, but other suitable cross sections may be used. Similarly, the second flow diverters 688 are illustrated with a circular cross section, but other suitable cross sections may be used.

The first and second flow diverters 684, 688 may be rotated at the same or different rotational speeds and in the same or different rotational directions. However, it is contemplated that the un-matched shapes of the first and second flow diverters 684, 688 will lend themselves to different rotational speeds and/or directions to control the overlying portions thereof and control the creation and location of the shear zone at different rotational locations and even axial locations along the rotating filter 664.

It likely goes without saying, but aspects of the various embodiments may be combined in any desired manner to accomplish a desired utility. For example, various aspects of the fourth and fifth embodiment may be combined as desired to effect the co- or counter-rotation of either or both of the first and second flow diverters relative to the filter at a fixed or varying relative speed.

There are a plurality of advantages of the present disclosure arising from the various features of the apparatuses and systems described herein. For example, the embodiments of the apparatus described above allow for enhanced filtration such that soil is filtered from the liquid and not re-deposited on utensils. Further, the embodiments of the apparatus described above allow for cleaning of the filter throughout the life of the dishwasher and this maximizes the performance of the dishwasher. Thus, such embodiments require less user maintenance than required by typical dishwashers. The amount of energy required to rotate the flow diverters may be minimal compared to other contemporary filter cleaning mechanisms. Further, the rotating flow diverters located on the upstream side of the filter may also act to deflect hard objects away from the filter thereby reducing damage to the filter.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a dishwasher, the method comprising:

providing a dishwasher for treating utensils according to a cycle of operation, comprising:

a tub at least partially defining a treating chamber;

a liquid spraying system configured to supply a spray of liquid to the treating chamber;

a liquid recirculation system having a recirculation flow path configured to recirculate sprayed liquid from the treating chamber to the liquid spraying system;

a rotating filter having an upstream surface and a downstream surface and located within the recirculation flow path such that the recirculation flow path passes through the rotating filter from the upstream surface to the downstream surface to effect a filtering of the sprayed liquid;

a first artificial boundary spaced from and rotating relative to one of the downstream and upstream surfaces to form an increased shear force zone therebetween wherein liquid passing between the first artificial boundary and the rotating filter applies a greater shear force on the at least one of the downstream and upstream surfaces than liquid in an absence of the first artificial boundary; and a drive system means for driving the rotating filter and driving the first artificial boundary to effect their relative rotation; and simultaneously rotating the filter and the first artificial boundary to form the increased shear force zone.

2. The method of claim 1 wherein the filter and the first artificial boundary are rotated in opposite directions.

3. The method of claim 2 wherein the filter and the first artificial boundary are rotated at different speeds.

4. The method of claim 1 wherein the filter and the first artificial boundary are rotated in the same direction.

5. The method of claim 4 wherein the filter and the first artificial boundary are rotated at different speeds.

* * * * *